US008801816B2

(12) United States Patent
Okuno et al.

(10) Patent No.: US 8,801,816 B2
(45) Date of Patent: Aug. 12, 2014

(54) CEMENTED CARBIDE AND CUTTING TOOL USING SAME

(75) Inventors: Takuya Okuno, Itami (JP); Kazuhiro Hirose, Itami (JP); Hideki Moriguchi, Itami (JP); Akihiko Ikegaya, Itami (JP); Kazuo Sasaya, Toyama (JP); Yoshiharu Yamamoto, Toyama (JP)

(73) Assignees: Sumitomo Electric Industries, Ltd., Osaka-shi (JP); Sumitomo Electric Hardmetal Corp., Itami-shi (JP); A.L.M.T. Corp., Tokyo (JP)

( * ) Notice: Subject to any disclaimer, the term of this patent is extended or adjusted under 35 U.S.C. 154(b) by 145 days.

(21) Appl. No.: 13/390,841

(22) PCT Filed: Aug. 11, 2010

(86) PCT No.: PCT/JP2010/063630

§ 371 (c)(1),
(2), (4) Date: Feb. 16, 2012

(87) PCT Pub. No.: WO2011/021554

PCT Pub. Date: Feb. 24, 2011

(65) Prior Publication Data

US 2012/0144753 A1 Jun. 14, 2012

(30) Foreign Application Priority Data

Aug. 20, 2009 (JP) ..... 2009-191493

(51) Int. Cl.
*B24B 1/00* (2006.01)
*B24D 11/00* (2006.01)

(52) U.S. Cl.
USPC ..... 51/295; 51/309

(58) Field of Classification Search
None
See application file for complete search history.

(56) References Cited

U.S. PATENT DOCUMENTS 4,769,070 A * 9/1988 Tobioka et al. ..... 75/238
5,020,394 A * 6/1991 Nakamura et al. ..... 76/108.6
5,100,703 A * 3/1992 Saijo et al. ..... 427/249.7
5,204,167 A * 4/1993 Saijo et al. ..... 428/212

(Continued)

FOREIGN PATENT DOCUMENTS

CN 1177018 A 3/1998
JP 1-191760 A 8/1989

(Continued)

OTHER PUBLICATIONS

Office Action in Chinese Patent Application No. 201080036720.3, dated Jan. 28, 2013.

*Primary Examiner* — Kaj K Olsen
*Assistant Examiner* — Ross J Christie
(74) *Attorney, Agent, or Firm* — Venable LLP; Michael A. Sartori; Tamatane J. Aga

(57) ABSTRACT

There are provided a cemented carbide high in thermal diffusivity and excellent in wear resistance, and a cutting tool including a base material formed of this cemented carbide. The cemented carbide is a WC based cemented carbide in which a hard phase mainly constituted of WC grains is bound by a binder phase mainly constituted of Co, and is used for a cutting tool. The binder phase is substantially constituted of Co, or Co and Ni. A total content of Co and Ni is not less than 4.5 mass % and not more than 15 mass %. In this cemented carbide, the WC grains have an average diameter of not less than 0.4 μm and not more than 4 μm.

10 Claims, 2 Drawing Sheets

(56) References Cited

U.S. PATENT DOCUMENTS

| | | | | |
|---|---|---|---|---|
| 5,791,422 | A * | 8/1998 | Liang et al. | 175/374 |
| 6,010,283 | A * | 1/2000 | Henrich et al. | 407/119 |
| 6,022,175 | A * | 2/2000 | Heinrich et al. | 407/119 |
| 6,126,709 | A | 10/2000 | Akerman et al. | |
| 6,423,112 | B1 | 7/2002 | Akerman et al. | |
| 6,655,882 | B2 * | 12/2003 | Heinrich et al. | 408/144 |
| 6,692,690 | B2 | 2/2004 | Akerman et al. | |
| 2002/0029910 | A1 * | 3/2002 | Heinrich et al. | 175/394 |
| 2007/0082229 | A1 * | 4/2007 | Mirchandani et al. | 428/698 |
| 2008/0029310 | A1 * | 2/2008 | Stevens et al. | 175/374 |
| 2008/0073125 | A1 * | 3/2008 | Eason et al. | 175/432 |

FOREIGN PATENT DOCUMENTS

| | | | |
|---|---|---|---|
| JP | 8-225877 | A | 9/1996 |
| JP | 10-121182 | A | 5/1998 |
| JP | 2004-52110 | A | 2/2004 |
| JP | 2008-284638 | A | 11/2008 |
| JP | 2009-7615 | A | 1/2009 |

* cited by examiner (I) SAMPLE No. 12

(II) SAMPLE No. 103

CEMENTED CARBIDE AND CUTTING TOOL USING SAME

TECHNICAL FIELD

The present invention relates to a cemented carbide suitable as a material for a cutting tool, and a cutting tool including a base material formed of this cemented carbide. In particular, the present invention relates to a cemented carbide excellent in both thermal crack resistance and wear resistance.

BACKGROUND ART

Conventionally, as a material for a cutting tool, there has been employed a WC based cemented carbide obtained by sintering WC (tungsten carbide) particles by Co (cobalt).

A cutting tool has a cutting edge, which usually has a high temperature due to heat resulting from deformation and friction when cutting a workpiece. Hence, the cutting tool needs to be formed of a material (base material) capable of maintaining sufficient hardness and strength even when it has a high temperature. Conventionally, in order to improve the wear resistance of the cutting tool when it has a high temperature, high-temperature hardness thereof is improved by introducing an element such as Ti, Nb, Ta, or Zr into a cemented carbide, which serves as the material thereof. Alternatively, a surface of the tool is coated with a ceramics film high in high-temperature hardness, such as alumina, titanium carbide, or the like. Meanwhile, in order to decrease the temperature of the cutting tool itself or the workpiece itself, it is effective to use a cutting fluid. Japanese Patent Laying-Open No. 08-225877 (hereinafter, referred to as "Patent Literature 1") discloses a sintered alloy having a surface provided with a layer having many WC particles of high thermal conductivity in order to increase the thermal conductivity of the surface of the alloy. A surface of an alloy is likely to have a high temperature.

CITATION LIST

Patent Literature

PTL 1: Japanese Patent Laying-Open No. 08-225877

SUMMARY OF INVENTION

Technical Problem

However, such a conventional cutting tool does not have properties sufficient for usage under cutting conditions in which a large amount of heat is generated during cutting such as high-speed cutting or machining of a difficult-to-cut material. Hence, the properties need to be further improved.

The use of the above-described cutting fluid effectively suppresses wear in continuous cutting. However, in intermittent cutting, the cutting fluid provides strong thermal shock upon slipping to likely generate thermal cracks, whereby the tool is prone to become chipped.

Ceramics constituting the coated film generally has a low thermal diffusivity. Hence, when the coated film is provided on the surface of the tool, heat is less likely to be transferred from the coated film on the surface of the tool to the base material inside the tool. This provides an effect of reducing thermal shock imposed on the base material. However, only such a thermal insulation effect provided by the coated film is not sufficient to meet recent demands for faster cutting speed.

Meanwhile, when cutting a difficult-to-cut material, the coated film is prone to come off due to a higher cutting temperature than normal and a phenomenon of causing the coated film to be melted and adhered to the workpiece more likely. Accordingly, the effect of suppressing thermal cracks by the coated film cannot be exhibited sufficiently. In particular, workpieces difficult to be cut have begun to be used more often in recent years. Accordingly, an amount of heat generated at the surface of the tool tends to become large. Accordingly, heat is likely to be kept in the tool, which noticeably raises a problem of the generation of thermal cracks.

Meanwhile, if a large amount of elements is added to achieve high-temperature hardness of the cemented carbide, the toughness and thermal diffusivity of the base material are decreased. The decrease of the thermal diffusivity of the base material results in decreased thermal crack resistance.

On the other hand, as described in Patent Literature 1, only with the improvement of thermal conductivity near the surface of the tool, a temperature difference becomes large in the vicinity of a boundary between a high thermal conductivity portion at the tool's surface side and a low thermal conductivity portion at the tool's internal side. Accordingly, thermal cracks may be generated.

In order to achieve a long life of the cutting tool used under such service conditions that its cutting edge is likely to have a high temperature, it is required to improve durability thereof against thermal shock. In view of the above, the present invention has its object to provide a cemented carbide excellent in thermal crack resistance and wear resistance and suitable as a material for a cutting tool. Another object of the present invention is to provide a cutting tool excellent in thermal crack resistance and wear resistance.

Solution to Problem

In a cemented carbide of the present invention, a hard phase mainly constituted of WC is sintered by a binder phase mainly constituted of Co. The binder phase is substantially constituted of Co, or Co and Ni, and a total content of Co and Ni is not less than 4.5 mass % and not more than 15 mass %. The WC grains of the cemented carbide have an average diameter of not less than 0.4 μm and not more than 4 μm. Assuming that the average diameter of the WC grains in the cemented carbide is represented by x (μm), the cemented carbide has a thermal diffusivity X ($cm^2$/sec) satisfying $X>0.055x+0.238$.

The cemented carbide preferably further contains only Cr at not less than 0.05 mass % and not more than 3 mass %. Furthermore, the cemented carbide preferably further contains Cr and one or more elements selected from Ta, Nb, Zr, and Ti at not less than 0.05 mass % and not more than 5 mass % in total.

The cemented carbide preferably contains Cr and one or more elements of Ta and Nb at not less than 0.05 mass % and not more than 5 mass % in total.

The binder phase is preferably substantially constituted of Co and Ni, and a content of Ni therein is not more than 25% relative to the total content of Co and Ni.

The cemented carbide preferably has a coercive force (Hc) equal to or smaller than 16 kA/m. The cemented carbide preferably further contains Cr at not less than 0.05 mass % and not more than 2 mass %, and contains Ta at not less than 0.2 mass % and not more than 5 mass %, grains constituting the hard phase has an average grain diameter of not less than 1 μM and not more than 4 μm, a content of Co therein is not less than 7 mass % and not more than 12 mass %, and the cemented carbide is used for a tool for machining a crankshaft.

The cemented carbide preferably further contains Cr at not less than 0.05 mass % and not more than 1.2 mass %, grains constituting the hard phase has an average grain diameter of not less than 0.5 μm and not more than 3 μm, a content of Co therein is not less than 4.5 mass % and not more than 9 mass %, and the cemented carbide is used for a tool for machining titanium.

The present invention also relates to a cutting tool. The cutting tool includes a base material formed of the above-described cemented carbide; and a coated film formed on a surface of the base material by means of a PVD method, characterized in that the coated film is constituted of one or more of diamondlike carbon (DLC) and a compound of a first element and a second element, the first element being one or more of elements of groups 4a, 5a, and 6a in a periodic table, Al, and Si, the second element being one or more of carbon (C), nitrogen (N), oxygen (O), and boron (B).

A cutting tool of the present invention includes: a base material formed of the above-described cemented carbide; and a coated film formed on a surface of the base material by means of a CVD method, characterized in that the coated film being constituted of one or more of diamond and a compound of a first element and a second element, the first element being one or more of elements of groups 4a, 5a, and 6a in a periodic table, Al, and Si, the second element being one or more of carbon (C), nitrogen (N), oxygen (O), and boron (B).

Advantageous Effects of Invention

The cemented carbide of the present invention is configured as described above and therefore has a high thermal diffusivity across the entire cemented carbide, rather than only at the surface of the cemented carbide. The cutting tool including the base material formed of the cemented carbide of the present invention has such a thermal diffusivity across the whole tool. Hence, thermal cracks, which are otherwise caused by a partial thermal expansion difference, can be suppressed from being produced. In this way, a long life thereof can be achieved. Further, even when cutting a difficult-to-cut material, which is likely to result in a high temperature and tends to result in local temperature rise during the cutting, the cutting tool including the base material formed of the cemented carbide of the present invention can decrease this tendency because the thermal diffusivity is high in the whole tool. Hence, this cutting tool can suppress decrease of cutting edge strength and development of wear, and is therefore excellent in wear resistance and toughness.

The thermal diffusivity and high-temperature hardness of the cemented carbide of the present invention are high. Hence, the cutting tool including the base material formed of the cemented carbide of the present invention is excellent in thermal crack resistance and wear resistance.

DESCRIPTION OF EMBODIMENTS

Figure 1:
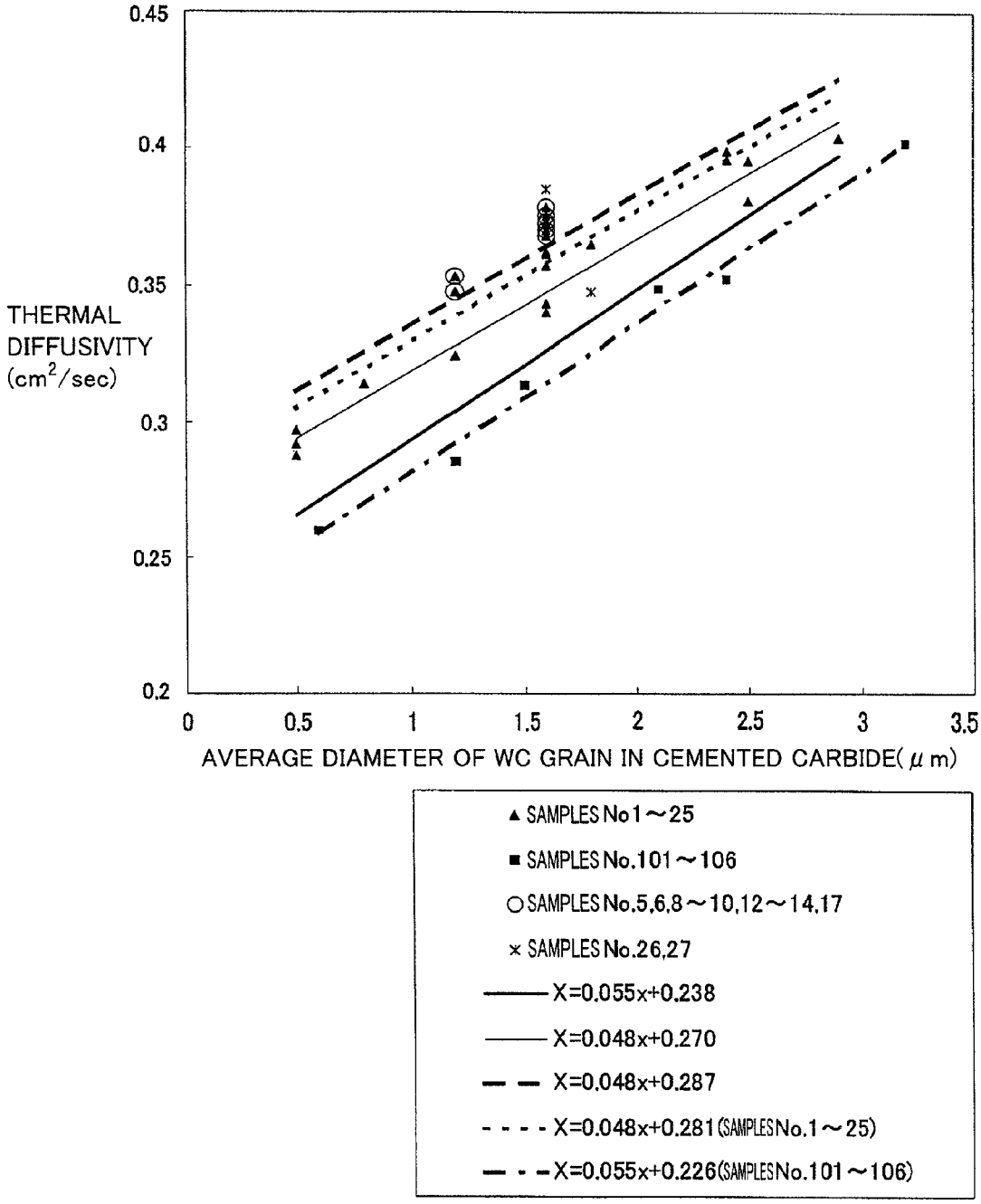
FIG. 1 is showing a relation between an average diameter of WC grains in each cemented carbide and thermal diffusivity thereof.

The following describes the present invention in detail.

<Cemented Carbide>

<<Composition>>

[Hard Phase]

A cemented carbide of the present invention is a WC based cemented carbide containing WC grains the most in a hard phase. The WC grains substantially constitute a part of the cemented carbide, apart from below-described compound grains, binder phase, and inevitable impurity. When the hard phase is substantially constituted only by the WC grains, thermal crack resistance, toughness, and hardness become excellent. Further, wear resistance becomes excellent when the hard phase contains, in addition to the WC grains, a compound of at least one metal selected from elements of groups 4a, 5a, and 6a in the periodic table (except WC) and at least one element of carbon and nitrogen, i.e., contains compound grains including one compound or two or more compounds of carbide, nitride, and carbonitride of the above-described metal and a solid solution thereof (except WC). Specific examples of such compounds include TaC, (Ta, Nb)C, VC, $Cr_3C_2$, NbC, TiCN, and the like.

When the cemented carbide of the present invention contains the above-described compound grains, the total content of the metallic elements other than W and constituting the compound grains is preferably not less than 0.05 mass % and not more than 5 mass %. Accordingly, thermal diffusivity described below is less decreased, which leads to excellent wear resistance and thermal crack resistance. Further, as described below, it is preferable to produce the cemented carbide such that WC, which is a source material thereof, has and maintains a shape with a rounded edge, straightforwardly, a generally spherical shape. This results in high thermal diffusivity and excellent thermal crack resistance.

[Binder Phase]

The binder phase contains Co the most. In addition to Co, it may contain another iron group element such as Ni or Fe, but the binder phase is preferably substantially constituted only by Co, or substantially constituted of Co and Ni. When the binder phase contains Ni, the thermal diffusivity thereof tends to decrease. Hence, in consideration of toughness and thermal diffusivity, the binder phase is preferably constituted only by Co. The total content of Co and Ni in the cemented carbide is set at not less than 4.5 mass % and not more than 15 mass %. If the total content thereof is less than 4.5 mass %, the content ratio of WC, which has high thermal diffusivity, becomes large but the toughness thereof becomes insufficient. This leads to insufficient effect of suppressing thermal cracks. When an amount of the binder phase is increased, the toughness will be improved. However, if the total content of Co and Ni exceeds 15 mass %, the content of WC is relatively reduced to result in decreased thermal diffusivity described below. Further, the decrease of WC leads to decreased hardness, with the result that the wear resistance is likely to be decreased. In particular, when the total content of Co and Ni is not less than 6 mass % and not more than 13 mass %, the cemented carbide to be obtained can be readily sintered and therefore dense. In addition, high hardness and high toughness can be balanced well in the cemented carbide. Thus, the cemented carbide is high in thermal diffusivity and excellent in wear resistance and toughness. When the binder phase contains Ni, the content of Ni is preferably 25% or smaller, more preferably, 10% or smaller relative to the total content of Co and Ni. It should be noted that the expression "substantially constituted" encompasses a case where it is constituted of Co apart from an inevitable impurity, a case where it is constituted of Co and Ni apart from an inevitable impurity, or a case where it is constituted of a solid solution of a component element (such as W or Cr) of the compound (such as WC or $Cr_3C_2$) used as the source material.

[Other Element Contained]

Apart from the composition constituted of WC, Co (or Co and Ni), and the inevitable impurity, the cemented carbide of the present invention may have a composition constituted of WC, Co (or Co and Ni), the following added element(s), and an inevitable impurity. The added element(s) may be one element or two or more elements selected from Cr, Ta, Nb, Zr, and Ti. When the element(s) are contained at not less than 0.05 mass % and not more than 5.0 mass % in total, grain growth of particles (mainly, the WC particles) constituting the hard phase is suppressed. Accordingly, the size and shape of the powders used for the source material can be readily maintained. In particular, when the element(s) thus providing the effect of inhibiting the grain growth, such as Cr, are contained therein at an amount falling within the above-described range, it is expected to reduce decrease of hardness and contribute to improved high-temperature hardness and improved thermal diffusivity as described below. Accordingly, a cutting tool including the base material formed of the cemented carbide of the present invention containing the element(s) such as Cr as described above is expected to have high cutting properties (wear resistance and thermal crack resistance) due to a synergistic effect of the grain growth inhibiting effect and the improved thermal diffusivity. When two or more added elements are contained therein, the cemented carbide preferably contains Cr and one or more elements selected from Ta, Nb, Zr, and Ti. More preferably, the cemented carbide contains Cr and one or more elements selected from Ta and Nb. When the cemented carbide contains Ta and/or Nb, decrease of thermal diffusivity and toughness is smaller as compared with a case where it contains Ti and/or Zr. Also, the grain growth inhibiting effect is increased due to a synergistic effect with Cr. When only one added element is contained therein, it is preferable that the cemented carbide contains only Cr because the synergistic effect provided by the grain growth inhibiting effect and the improved thermal diffusivity tends to be exhibited the best in this case. The content of Cr is preferably not less than 0.05 mass % and not more than 3 mass %. When the content of the added element(s) is smaller than 0.05 mass %, the above-described effect is unlikely to be obtained sufficiently. On the other hand, when the content thereof exceeds 5 mass %, the thermal diffusivity is likely to be decreased. In particular, in the case where only Cr is contained therein, the content of Cr is preferably not less than 0.3 mass % and not more than 3 mass %. In the case where the cemented carbide contains Cr and an element of those exemplified above such as Ta, the content of Cr is preferably not less than 0.05 mass % and not more than 3 mass %. The total content thereof is preferably not less than 0.3 mass % and not more than 5 mass %. The added element(s) come into existence in the cemented carbide by using a single element for the source material, or by using a compound of a carbide including the above-described metallic element therefor (for example, TaNbC, $Cr_3C_2$, or the like). The compound thus used for the source material remains as a compound in the cemented carbide without a change, forms a new composite compound therein, or becomes a single element.

It should be noted that V is frequently used as a grain growth inhibitor, but it is preferable that the cemented carbide of the present invention does not contain V. This is because V provides too strong grain growth inhibiting effect and accordingly inhibits an effect of enhancing binding between adjacent WC grains due to slight melting and redeposition of WC during sintering, with the result that the thermal diffusivity thereof is decreased.

<<Shape of Hard Phase>>

The present inventors have used, as the source material, WC having a shape with a rounded edge (hereinafter, also referred to as "edge-rounded shape") rather than WC having a shape with a sharp edge, and have fabricated the cemented carbide so that the shape thereof is preserved. Then, the cemented carbide accordingly obtained (cemented carbide having WC with the edge-rounded shape therein) was examined and it was found that the thermal diffusivity thereof was high. Hence, it is considered that the edge-rounded shape, i.e., generally spherical shape of each of the hard phase in the cemented carbide is closely associated with the high thermal diffusivity of the cemented carbide. A reason for this is considered as follows. That is, the WC grains each having the rounded shape are likely to have a wide contact area therebetween, as compared with the WC having the shape with a sharp edge. Accordingly, thermal diffusion is likely to take place through the WC grains each having the high thermal diffusivity. An alternative reason therefor is considered as follows. That is, the WC having the rounded shape is likely to provide a small surface area to result in a small interface between WC and Co in the entire cemented carbide, which leads to increased thermal diffusivity in the entire cemented carbide. From the interface between WC and Co, heat is less likely to be diffused.

Further, the present inventors have found that the cemented carbide will have high thermal diffusivity and excellent thermal property when the content of WC particles each having a shape with a sharp edge falls in or falls below a predetermined range in a cross section of the cemented carbide as compared with the conventional cemented carbide having substantially all the WC particles having acute shapes with sharp edges. For example, in an SEM image (magnification of 3000) of the cross section of the cemented carbide, the number of sharp edges each having a curvature radius of 100 nm or smaller is counted among the edges of the WC grains. Then, the average number thereof is found among areas of 10 μm×10 μm (average number of values thereof found for five areas (average with n=5); hereinafter, this average number is referred to as "the number of sharp edges"). This average number is divided by the average number of grains, which is determined from the average diameter of the WC grains and the volume ratio of the WC grains ($\{100\ \mu m^2 \times (\text{volume \% of WC})\}/\{(\text{average diameter}/2)^2 \times n\}$), thereby determining the average number of sharp edges per WC grain. The average number of sharp edges per WC grain in the cemented carbide employing WC having the edge-rounded shape as its source material and fabricated with the shape thereof being maintained is small, specifically, not more than 0.25, which reflects the structure of WC with the edge-rounded shape. Accordingly, the cemented carbide satisfying the condition of the average number of sharp edges per WC grain≤0.25 is high in thermal diffusivity and excellent in the other properties and is therefore expected to be suitable as a material for a cutting tool.

<<Size of Hard Phase>>

When the grain size of the hard phase, which are mainly constituted of the WC grains, have an average diameter of not less than 0.4 μm and not more than 4 μm, the hard phase grains provide excellent wear resistance and toughness and are therefore preferable. According to examination by the present inventors, when the WC grains are large, each of the hard phase grains will have a thermal diffusivity close to the intrinsic thermal diffusivity of WC, but will have decreased strength and hardness. Hence, in consideration of the superiority of the cemented carbide in thermal diffusivity as well as strength and hardness required for a cutting tool, the WC grain has an average diameter of 4 μm or smaller. On the other hand, when the WC grains are too small, the toughness thereof is likely to be decreased and the surface areas of the WC grains become large. This presumably result in that the cemented carbide is not sufficiently superior to the cemented carbide obtained using the conventional production method. In view of this, the average diameter of WC is set at 0.4 μm or larger. Although it depends on a purpose of use, it is particularly preferable that the average diameter thereof is not less than 0.8 μm and not more than 2.4 μm.

<<Thermal Property>>

The most distinctive feature of the cemented carbide of the present invention, which is formed of the above-described specific composition and contains the hard phase grains each having the above-described specific shape and size, lies in that assuming that the average diameter of the WC grains in the cemented carbide is represented by x (μm), thermal diffusivity X ($cm^2$/sec) thereof satisfies X>0.055x+0.238. The thermal diffusivity of the cemented carbide is correlated with the average diameter (grain size) of the WC grains, and a change in the grain diameter of WC dominantly acts to change thermal diffusivity thereof. The present inventors have fabricated various cemented carbides using different production methods and source materials, and have examined a relation between the grain diameter of WC in each of the cemented carbides and the thermal diffusivity thereof. It has been found that even when the same source material is used, a cemented carbide fabricated using a conventional production method has a thermal diffusivity X of 0.055x+0.238 or smaller. In contrast, it has been found that a cemented carbide fabricated using a below-described specific production method has a thermal diffusivity X exceeding 0.055x+0.238. Specifically, when produced using the below-described specific method, the cemented carbide has a thermal diffusivity X exceeding 0.048x+0.270 (X>0.048x+0.270), or has a thermal diffusivity X exceeding 0.048x+0.287 (X>0.048x+0.287). In other words, the cemented carbide of the present invention is sufficiently high in thermal diffusivity, is excellent in thermal crack resistance, and is excellent in wear resistance under a high temperature. When the grain diameter of each WC grain is larger, the cemented carbide has a high thermal diffusivity that finally converges to the intrinsic thermal diffusivity of WC, but such an oversized WC grain results in decreased hardness and strength. The cemented carbide of the present invention has a high thermal diffusivity while maintaining strength and hardness substantially equal to those of a conventional cemented carbide having WC grains serving as a main component of the hard phase and having the same size as the size of those of the cemented carbide of the present invention.

<<Coercive Force (Magnetic Coercive Force) Hc>>

The cemented carbide preferably has a coercive force (JIS G 0202(6204), 1987) of 16 kA/m or smaller to achieve high thermal diffusivity and toughness. Normally, when the grains constituting the hard phase are fine grains, Co, which mainly constitutes the binder phase, is subdivided to result in small average thickness of the Co phase. This leads to large coercive force. Hence, a cemented carbide having a coercive force exceeding 16 kA/m has a high content of fine WC grains in its cemented carbide structure, and tends to have a low thermal diffusivity or contains Co at an extremely small content and therefore cannot achieve sufficient toughness required for usage for a normal cutting tool. On the other hand, when the coercive force is too low, the content of large WC grains becomes high to result in decreased wear resistance. Hence, the coercive force is more preferably not less than 8 kA/m and not more than 15.5 kA/m. The coercive force can be set at 16 kA/m or smaller by adjusting the size of each WC grain and the amount of the binder phase in the cemented carbide.

<Production Method>

Generally, a cemented carbide is produced in the following steps: preparation of a source material→pulverization and mixing of the source material→drying→molding→sintering (→heat treatment if required). The pulverization and mixing is conventionally performed for a relatively long time (several hours to several ten hours) using a ball mill or an attritor. However, as a result of examination by the present inventors, it has been found that WC is excessively pulverized in the conventional method, which sufficiently mixes so as not to generate a porosity, thereby resulting in WC grains each having a shape with a sharp edge or resulting in production of a multiplicity of very fine WC grains. This leads to increased contact area between each WC grain and the binder phase (area of an interface of WC-Co). Accordingly, the binder phase such as Co, which has a thermal diffusivity lower than that of each WC grain, exists between the WC grains to obtain only a cemented carbide having a low thermal diffusivity. To address such a problem, the present inventors have considered to employ a media-less mixing using an axial mixer, a Henschel mixer, or the like. However, only with the media-less mixing, a cemented carbide with a good structure, thus, a cemented carbide excellent in thermal crack resistance was not obtained. As a result of various considerations, the following pre-process was performed before the mixing, thereby obtaining a cemented carbide excellent in thermal crack resistance, specifically, a cemented carbide satisfying X>0.055x+0.238 even though the mixing time was short. In the pre-process, a process for crushing aggregations is performed. An exemplary process thereof is to process the source material powders at a high pressure using a jet mill (a device for dispersing an object, such as the source material powders in slurry state or a mixture of gas and the source material powders, by discharging the object from its nozzle with a pressure). It should be noted that as a result of examination by the present inventors, it was found that upon collision of the powders, there occurs a difference in thermal dissipation between dry processing and wet processing in the pre-process. The dry processing tends to adversely affect crystallinity of the powders more likely. Hence, the wet processing, which employs the powders in slurry state, is more desirable.

The cemented carbide produced using the source material having been through the mixing taking a relatively short time after crushing the aggregations as described above has a high thermal diffusivity because each of the WC grains in the cemented carbide structure has a shape more rounded as compared with the WC grains in the conventional cemented carbide and the WC-Co interface, which causes decreased thermal diffusivity, is small. Further, by employing the production method including the above-described specific pulverization and mixing step, a cemented carbide with a good cemented carbide structure can be obtained even when the source material powders of fine grains (not more than 1 μm in FSSS (Fisher Sub-Sieve Sizer method)) are used, because the aggregations of the Co powders of the source material are little. Further, if source material(s) of the above-described added element(s) are directly mixed in the case of the cemented carbide containing the added element(s), aggregations thereof remain in the cemented carbide structure to result in decreased hardness. To address this, the above-described pre-process using the jet mill is performed, or preliminary pulverization is performed using an attritor or a ball mill before the mixing, thereby obtaining a cemented carbide having a good cemented carbide structure.

The drying, molding, sintering, and the like can be performed under general conditions. For example, the sintering is performed by retaining it in a vacuum atmosphere at 1320° C.-1500° C. for 1 to 2 hours.

<Purpose of Use>

The cemented carbide of the present invention is high in thermal diffusivity and excellent in thermal crack resistance, wear resistance, and toughness. Hence, the cemented carbide can be used as a material for a member required to attain thermal crack resistance, wear resistance, and toughness. For example, the cemented carbide is suitable as a material for cutting tools such as a milling cutting tool, a tool for machining a difficult-to-cut material, and a heavy cutting tool. In particular, the cemented carbide of the present invention is suitable as a material for a tool for machining a crankshaft. The tool for machining a crankshaft is required to attain thermal crack resistance.

When the cemented carbide is used as a material for the tool for machining a crankshaft, the cemented carbide preferably contains Co at a content of not less than 7 mass % and not more than 12 mass %, contains Cr at a content of not less than 0.05 mass % and not more than 2 mass %, and contains Ta at a content of not less than 0.2 mass % and not more than 5 mass %, wherein the grains constituting the hard phase have an average diameter of not less than 1 μm and not more than 4 μm. The cemented carbide of the present invention thus configured can achieve increased resistance to development of cracks, in addition to the high thermal diffusivity, which is a feature of the cemented carbide of the present invention.

When cutting each of titanium (Ti) and a Ti alloy as a workpiece, the workpiece is likely to be adhered to a surface of the tool. This adhesion involves falling of WC, which is considered as a large factor for development of wear. Further, each of Ti and the Ti alloy has a low thermal conductivity, and has heat likely to be concentrated on its tool edge portion during the cutting due to a short length of contact of a swarf therewith. In contrast, even when cutting each of Ti and the Ti alloy as a workpiece, the cemented carbide of the present invention can have a good wear resistance because each of the WC grains of the cemented carbide of the present invention has the edge-rounded shape as described above to suppress the falling of WC and the cemented carbide has the high thermal diffusivity. Accordingly, the cemented carbide of the present invention is suitable as a material for a tool used to cut Ti and the Ti alloy. When the cemented carbide of the present invention is used as a material for the tool for machining titanium, the cemented carbide preferably contains Co at a content of not less than 4.5 mass % and not more than 9 mass %, and contains Cr at a content of not less than 0.05 mass % and not more than 1.2 mass %, wherein the grains constituting the above-described hard phase have an average grain diameter of not less than 0.5 μm and not more than 3 μm.

By using the cemented carbide of the present invention as a base material and providing one or more coated films on the surface of the base material, a cutting tool (coated cutting tool) can be obtained. The film(s), which have high hardness, provide this cutting tool with further improved wear resistance. Moreover, the film(s) provide a thermal insulation effect to allow the cutting tool to have further improved thermal crack resistance. In particular, when the coated film(s) are formed on the cemented carbide of the present invention using a PVD method or a CVD method, the coated film(s) thus formed are more excellent in adhesive property, wear resistance, and resistance to chipping than those of a coated film formed on the conventional cemented carbide. This is due to the following reason. That is, in the cemented carbide of the present invention, the content of WC with sharp edges is low. Hence, fewer projections with sharp edges, which result from the WC with the sharp edges, exist at the surface of the cemented carbide. Here, when using the PVD method to form the film(s), the film(s) tend to grow from the hard phase at the surface of the cemented carbide. Accordingly, the coated film(s) thus formed using the PVD method on the cemented carbide of the present invention are more likely to be continuous along the surface of the base material as compared with a case of growing a film from hard phase grains having sharp edges. In this way, continuity of the coated film(s) can be improved in the surface direction of the film(s). This presumably leads to film quality more excellent in wear resistance and detachment resistance in the case of forming the film(s) using the PVD method on the cemented carbide of the present invention, as compared with that in the case of providing a coating on the conventional cemented carbide. On the other hand, when using the CVD method to form the film(s), the film(s) tend to grow from the binder phase at the surface of the cemented carbide, and are likely to be influenced by the size of an area of the binder phase exposed on the surface of the cemented carbide. The cemented carbide of the present invention contains fine WC grains at a small content and the area of the Co phase at the surface of the cemented carbide is not subdivided as described above. This presumably leads to improved crystallinity and adhesive property of the film(s) in the case of forming the film(s) on the cemented carbide of the present invention using the CVD method, as compared with those in a case of providing a coating on the conventional cemented carbide. As a result, coated film quality excellent in wear resistance can be obtained.

The coated film may be formed of one or two or more selected from a compound of one or more first elements and one or more second elements, diamond, diamondlike carbon (DLC), and cubic boron nitride (cBN). The one or more first elements are selected from elements of groups 4a, 5a, and 6a in the periodic table, Al, and Si. The one or more second elements are selected from carbon (C), nitrogen (N), oxygen (O), and boron (B). In other words, the compound is carbide, nitride, oxide, or boride of the first elements, or a solid solution thereof (for example, TiCN, $Al_2O_3$, TiAlN, TiN, AlCrN, or TiAlON). The coated film can be formed using either of the PVD method and the CVD method. In the case where diamond is used, it is preferable to use the CVD method. In the case where DLC is used, it is preferable to use the PVD method.

Example 1

Test Example 1

A plurality of WC based cemented carbides were fabricated using different production methods. The thermal diffusivity ($cm^2$/sec) of each of the cemented carbides and the average diameter (μm) of WC grains therein were examined.

For fabrication of the cemented carbides, the followings were prepared as source material powders: WC powders having an average particle diameter as shown in Table 1; $Cr_3C_2$ powders (average particle diameter: 2 μm); TaC powders (average particle diameter: 3 μm); NbC powders (average particle diameter: 3 μm); VC powders (average particle diameter: 2 μm); ZrC powders (average particle diameter: 2 μm); TiC powders (average particle diameter: 2 μm); Co powders (powders α: average particle diameter of 1.2 μm {samples No. 3, 7, 11, 16, 101-106}, powders β: average particle diameter of 0.5 μm {samples No. 1, 2, 4-6, 8-10, 12-15, 17-27}); and Ni powders (average particle diameter: 0.5 μm). They were added together to obtain compositions (mass %) shown in Table 1. The WC powders of the source material utilized were those carbonized at a high temperature (carbonization temperature: 1900-2170° C.). The WC powders thus produced through such high-temperature carbonization are high in crystallinity and excellent in thermal diffusivity. Hence, a cemented carbide having a high thermal diffusivity can be readily obtained. The other source material powders utilized were commercially available.

TABLE 1

| Sample No. | Source Material: Average Particle Diameter of WC Powder (μm) | Composition (mass %): WC | $Cr_3C_2$ | TaC | NbC | VC | ZrC | TiC | Co | Ni | Mixing Method | Mixing Time (h) |
|---|---|---|---|---|---|---|---|---|---|---|---|---|
| 1 | 0.5 | 90 | 0 | 0 | 0 | 0 | 0 | 0 | 10 | 0 | AM | 0.5 |
| 2 | 0.5 | 89.4 | 0.6 | 0 | 0 | 0 | 0 | 0 | 10 | 0 | AM | 1 |
| 3 | 0.5 | 88.4 | 0.6 | 0 | 0 | 1 | 0 | 0 | 10 | 0 | AM | 1 |
| 4 | 0.8 | 89.4 | 0.6 | 0 | 0 | 0 | 0 | 0 | 10 | 0 | AM | 1 |
| 5 | 1.4 | 89.4 | 0.6 | 0 | 0 | 0 | 0 | 0 | 10 | 0 | AM | 0.5 |
| 6 | 1.4 | 89.8 | 0.1 | 0.1 | 0 | 0 | 0 | 0 | 10 | 0 | AM | 1.5 |
| 7 | 1.4 | 89.8 | 0.1 | 0.1 | 0 | 0 | 0 | 0 | 10 | 0 | AM | 1 |
| 8 | 1.8 | 90 | 0 | 0 | 0 | 0 | 0 | 0 | 10 | 0 | AM | 1.5 |
| 9 | 1.8 | 90.9 | 0.6 | 0.5 | 0 | 0 | 0 | 0 | 7.5 | 0.5 | AM | 0.5 |
| 10 | 1.8 | 92 | 0 | 0 | 0 | 0 | 0 | 0 | 7.5 | 0.5 | AM | 0.5 |
| 11 | 1.8 | 88.5 | 0 | 0 | 0.5 | 0 | 0.5 | 0.5 | 7 | 3 | AM | 0.5 |
| 12 | 1.8 | 89.4 | 0.6 | 0 | 0 | 0 | 0 | 0 | 10 | 0 | AM | 2 |
| 13 | 1.8 | 89.4 | 0.6 | 0 | 0 | 0 | 0 | 0 | 8.5 | 1.5 | BM | 1 |
| 14 | 1.8 | 88.4 | 0.6 | 0 | 1 | 0 | 0 | 0 | 10 | 0 | BM | 0.5 |
| 15 | 1.8 | 85.7 | 2.3 | 0 | 0 | 0 | 0 | 0 | 12 | 0 | BM | 1 |
| 16 | 1.8 | 85.4 | 4.6 | 0 | 0 | 0 | 0 | 0 | 8.5 | 1.5 | BM | 1.5 |
| 17 | 1.8 | 93.4 | 0.6 | 0 | 0 | 0 | 0 | 0 | 6 | 0 | BM | 1 |
| 18 | 1.8 | 87.4 | 0.6 | 0 | 0 | 0 | 0 | 0 | 10 | 2 | BM | 2 |
| 19 | 1.8 | 87.4 | 0.6 | 0 | 0 | 0 | 0 | 0 | 10 | 2 | BM | 1 |
| 20 | 2.1 | 84.9 | 1.1 | 0 | 0 | 0 | 0 | 0 | 14 | 0 | BM | 3 |
| 21 | 2.8 | 90 | 0 | 0 | 0 | 0 | 0 | 0 | 10 | 0 | BM | 1 |
| 22 | 2.8 | 89.9 | 0.6 | 1 | 1.5 | 0 | 0.5 | 0.5 | 6 | 0 | BM | 1.5 |
| 23 | 2.8 | 86 | 0 | 0 | 0 | 0 | 0 | 0 | 10 | 4 | AM | 0.5 |
| 24 | 2.8 | 93.8 | 0.2 | 0 | 0 | 0 | 0 | 0 | 14 | 0 | AM | 0.5 |
| 25 | 3.4 | 89.4 | 0.6 | 0 | 0 | 0 | 0 | 0 | 14 | 0 | AM | 1 |
| 26 | 1.8 | 95.4 | 0.6 | 0 | 0 | 0 | 0 | 0 | 4 | 0 | BM | 0.5 |
| 27 | 2.1 | 78.7 | 2.3 | 2 | 0 | 0 | 0 | 0 | 17 | 0 | BM | 0.5 |
| 101 | 0.8 | 90 | 0 | 0 | 0 | 0 | 0 | 0 | 10 | 0 | ATR | 12 |
| 102 | 2 | 85.5 | 0 | 0.5 | 1 | 0 | 0 | 0 | 14 | 0 | ATR | 12 |
| 103 | 2.5 | 89.5 | 0 | 0.5 | 0 | 0 | 0 | 0 | 10 | 0 | BM | 24 |
| 104 | 4 | 88.9 | 0.6 | 0.5 | 0 | 0 | 0 | 0 | 9.5 | 0.5 | BM | 24 |
| 105 | 4 | 86 | 0 | 0 | 0 | 0 | 0 | 0 | 14 | 0 | ATR | 12 |
| 106 | 5 | 88 | 0 | 0 | 0 | 0 | 0 | 0 | 12 | 0 | ATR | 8 |

For each of samples No. 1-27, first, the source material powders added together were subjected to the pre-process using a jet mill. The pre-process is performed in a manner of wet processing or dry processing. In the case of the dry processing (samples No. 7, 19), pressure was set at 0.4 MPa. In the case of the wet processing (samples other than samples No. 7 and 19 among samples No. 1-27), pressure was set at 100 MPa. After the pre-process, the source material powders added together were pulverized and mixed using mixing methods for mixing times as shown in Table 1 (wet mixing). An axial mixer (AM), a ball mill (BM), and an attritor (ATR) utilized therefor were all commercially available.

Each of samples No. 101-106 was not subjected to the pre-process, and the source material powders were wet-mixed using the mixing methods for mixing times as shown in Table 1.

After the mixing, the following steps were performed: drying molding (at a molding pressure of 1000 kg/cm$^2$) sintering (in a vacuum atmosphere at 1400° C. for 1 hour). In this way, the cemented carbides of samples No. 1-27 and 101-106 were obtained.

For each of the cemented carbides thus obtained, the contents (mass %) of Cr, Ta, Nb, V, Zr, and Ti, the average diameter (μm) of the WC grains, the thermal diffusivity (cm$^2$/sec), and the coercive force (kA/m) were measured. Results of the measurement are shown in Table 2.

The contents (mass %) of Cr, Ta, Nb, V, Zr, and Ti were measured through EDX (Energy Dispersive X-ray Spectroscopy) analysis. The contents of Co and Ni in each cemented carbide were also measured through the EDX analysis and were found to be substantially the same as the amounts thereof used for the source material. Further, the composition of the hard phase in each of the cemented carbides was examined by means of X-ray diffraction and it was found that each hard phase of the samples was constituted substantially by the WC grains. It should be noted that the analysis of the composition can be done through XPS (X-ray Photoelectron Spectroscopy) or SIMS (secondary ion mass spectrometry).

The average diameter (μm) of the WC grains in each of the cemented carbides was measured using an EBSD (Electron Back-Scatter Diffraction) method that utilizes an FESEM (Field Emission Scanning Electron Microscope). Specifically, the measurement was performed in the following manner. That is, each of the cemented carbides was taken along appropriate cross sections (here, two cross sections). In each of the cross sections, for a plurality of visual fields (here, two visual fields each with, 500 μm$^2$), WC grains were identified (mapped) in accordance with orientations of the crystal grains. The equivalent circle diameter of an area of each of the WC grains in each visual field was determined. The equivalent circle diameter thus determined was regarded as the diameter of the WC grain. The average of the diameters was regarded as an average grain diameter in this visual field. Further, an average of the average grain diameters in all the visual fields (here, four visual fields because the two visual fields were taken for each of the two cross sections) was regarded as the average diameter of the WC grains, and is shown in Table 2. The diameters of the WC grains were measured under conditions that acceleration voltage was set at 15 kV, illumination current was set at 1.0 nA, and scanning step was set at 75 nm. For this measurement, a commercially available EBSD device can be used.

Then, each of the cemented carbides was processed to have $\phi$ of 10 mm×2 mm and the thermal diffusivity ($cm^2$/sec) of the cemented carbide thus processed was measured using a laser flash method. Thermal diffusivity was measured at each of five points selected in each sample, and an average of the thermal diffusivities at the five points was regarded as the thermal diffusivity of the sample and is shown in Table 2.

The coercive force (kA/m) was measured using a commercially available measuring device.

Further, a correlation between average diameter x of the WC grains in each of the obtained cemented carbides and thermal diffusivity X thereof was approximated by means of a least square method. A result of the approximation (straight line of a linear function) is shown in FIG. 1. Samples No. 1-25, which were fabricated by using the source material containing Co at a content of 4.5-15 mass % and mixing it for a short time using an axial mixer or a ball mill after the pre-process, were approximated in accordance with the following approximate expression: X=0.048x+0.281. On the other hand, samples No. 101-106, which were fabricated through long-time mixing and pulverization using a ball mill or an attritor, were approximated in accordance with the following approximate expression: X=0.055x+0.226. From the approximate expressions, each of samples No. 1-25 and each of samples No. 101-106 can be distinguished by a straight line inclined by 0.055. Thus, as the straight line distinguishing samples No. 1-25 and samples No. 101-106 from each other, a straight line of linear function inclined by 0.055 was employed to find an intercept (intersection with the vertical axis) in the following manner. That is, when a straight line inclined by 0.055 and passing through each data point of each of samples No. 1-25 was taken, the minimum value of each intercept was 0.2435. On the other hand, when a straight line inclined by 0.055 and passing through each data point of each of samples No. 101-106 was taken, the maximum value of each intercept was 0.2325. An intermediate value between the minimum value of the intercept, 0.2435, and the maximum value of the intercept, 0.2325, was 0.238 and was regarded as the intercept of the straight line for distinguishing them as described above. From the above, X=0.055x+0.238 was obtained as the straight line distinguishing samples No. 1-25 and samples No. 101-106 from each other.

Meanwhile, a straight line of linear function inclined by 0.048 was employed as a straight line distinguishing each of samples No. 2, 4-6, 8-15, 17, 18, 20-22, 24 (hereinafter, referred to as "group $\alpha$") and each of the other samples (hereinafter, referred to as "group $\beta$") among samples No. 1-25 from each other. In each of the samples of group $\alpha$, a relation between the average diameter of the WC grains and the thermal diffusivity was in a more preferable state. Then, an intercept thereof (intersection with the vertical axis) was found in the following manner. When a straight line inclined by 0.048 and passing through each data point of each of the samples of group $\alpha$ was taken, the minimum value of each intercept was 0.273. When a straight line passing through each data point of each of the samples of group $\beta$ was taken, the maximum value of each intercept was 0.268. An intermediate value between the minimum value of the intercept, 0.273, and the maximum value of the intercept, 0.268, was 0.270 and was regarded as the intercept of the straight line distinguishing them from each other as described above. From the above, X=0.048x+0.270 was obtained as the straight line distinguishing group $\alpha$ and group $\beta$ from each other. Likewise, X=0.048x+0.287 was obtained as a straight line distinguishing each of more preferable samples No. 5, 6, 8-10, 12-14, 17 and each of the other samples from each other. Values thereof determined from the approximate expressions are also shown in Table 2.

TABLE 2

| Sample No. | Total Content of Cr, Ta, Nb, Zr, Ti, V (mass %) | Average Diameter of WC Grain (μm) | Thermal Diffusivity ($cm^2$/sec) | X = 0.055x + 0.238 | X = 0.048x + 0.270 | X = 0.048x + 0.287 | Coercive Force (kA/m) |
|---|---|---|---|---|---|---|---|
| 1 | 0 | 0.5 | 0.292 | 0.2655 | 0.294 | 0.311 | 26.2 |
| 2 | Cr: 0.5 | 0.5 | 0.297 | 0.2655 | 0.294 | 0.311 | 27.6 |
| 3 | Cr, V: 1.5 | 0.5 | 0.288 | 0.2655 | 0.294 | 0.311 | 28.3 |
| 4 | Cr: 0.5 | 0.8 | 0.314 | 0.282 | 0.3084 | 0.3254 | 22.1 |
| 5 | Cr: 0.5 | 1.2 | 0.353 | 0.304 | 0.3276 | 0.3446 | 17.5 |
| 6 | Cr, Ta: 0.2 | 1.2 | 0.347 | 0.304 | 0.3276 | 0.3446 | 16.8 |
| 7 | Cr, Ta: 0.2 | 1.2 | 0.324 | 0.304 | 0.3276 | 0.3446 | 16.7 |
| 8 | 0 | 1.6 | 0.373 | 0.326 | 0.3468 | 0.3638 | 12.6 |
| 9 | Cr, Ta: 1.0 | 1.6 | 0.378 | 0.326 | 0.3468 | 0.3638 | 13.9 |
| 10 | 0 | 1.6 | 0.370 | 0.326 | 0.3468 | 0.3638 | 13.2 |
| 11 | Nb, Zr, Ti: 1.5 | 1.6 | 0.362 | 0.326 | 0.3468 | 0.3638 | 12.4 |
| 12 | Cr: 0.5 | 1.6 | 0.368 | 0.326 | 0.3468 | 0.3638 | 13 |
| 13 | Cr: 0.5 | 1.6 | 0.373 | 0.326 | 0.3468 | 0.3638 | 12.9 |
| 14 | Cr, Nb: 1.5 | 1.6 | 0.372 | 0.326 | 0.3468 | 0.3638 | 13.5 |
| 15 | Cr: 2 | 1.6 | 0.357 | 0.326 | 0.3468 | 0.3638 | 11.7 |
| 16 | Cr: 4 | 1.6 | 0.343 | 0.326 | 0.3468 | 0.3638 | 13.2 |
| 17 | Cr: 0.5 | 1.6 | 0.375 | 0.326 | 0.3468 | 0.3638 | 15.3 |
| 18 | Cr: 0.5 | 1.6 | 0.361 | 0.326 | 0.3468 | 0.3638 | 11.4 |
| 19 | Cr: 0.5 | 1.6 | 0.340 | 0.326 | 0.3468 | 0.3638 | 11.6 |
| 20 | Cr: 1.0 | 1.8 | 0.365 | 0.337 | 0.3564 | 0.3734 | 10.1 |
| 21 | 0 | 2.5 | 0.395 | 0.3755 | 0.39 | 0.407 | 8.5 |
| 22 | Cr, Nb, Zr, | 2.4 | 0.396 | 0.37 | 0.3852 | 0.4022 | 7.9 |

TABLE 2-continued

| Sample No. | Total Content of Cr, Ta, Nb, Zr, Ti, V (mass %) | Average Diameter of WC Grain (μm) | Thermal Diffusivity ($cm^2$/sec) | X = 0.055x + 0.238 | X = 0.048x + 0.270 | X = 0.048x + 0.287 | Coercive Force (kA/m) |
|---|---|---|---|---|---|---|---|
| | Ti: 3.5 | | | | | | |
| 23 | 0 | 2.5 | 0.381 | 0.3755 | 0.39 | 0.407 | 7.5 |
| 24 | Cr: 0.2 | 2.4 | 0.399 | 0.37 | 0.3852 | 0.4022 | 8.9 |
| 25 | Cr: 0.5 | 2.9 | 0.404 | 0.3975 | 0.41 | 0.4262 | 7.4 |
| 26 | Cr: 0.5 | 1.6 | 0.385 | 0.326 | 0.345 | 0.365 | 17.2 |
| 27 | Cr, Ta: 4 | 1.8 | 0.347 | 0.337 | 0.355 | 0.375 | 9.2 |
| 101 | 0 | 0.6 | 0.26 | 0.271 | 0.295 | 0.315 | 26 |
| 102 | Ta, Nb: 1.5 | 1.2 | 0.285 | 0.304 | 0.325 | 0.345 | 18.5 |
| 103 | Ta: 0.5 | 1.5 | 0.313 | 0.3205 | 0.34 | 0.36 | 15.7 |
| 104 | Cr, Ta: 1 | 2.1 | 0.348 | 0.3535 | 0.37 | 0.39 | 7.7 |
| 105 | 0 | 2.4 | 0.352 | 0.37 | 0.385 | 0.405 | 9.3 |
| 106 | 0 | 3.2 | 0.402 | 0.414 | 0.425 | 0.445 | 9.3 |

As shown in Table 2, it is understood that a cemented carbide having a high thermal diffusivity can be obtained by performing the specific pre-process before the short-time mixing. In particular, each of the cemented carbides of samples No. 1-25 obtained by performing the pre-process before the short-time mixing had a thermal diffusivity higher than those of samples No. 101-106 obtained using the conventional production method, and satisfied X>0.055x+0.238, with the average diameter of the WC grains in each of the cemented carbides of samples No. 1-25 being the same as that of each of samples No. 101-106.

From Tables 1 and 2, the following findings are obtained:

1. With the composition being the same, the thermal diffusivity tends to be higher as the average diameter of WC grain in the cemented carbide is larger.

2. With the content of the added element(s) being the same, the thermal diffusivity tends to be higher as the total content of Co and Ni that serve as the binder phase is smaller.

3. Even if part of Co is substituted by Ni, a cemented carbide having a high thermal diffusivity is obtained by performing the pre-process before the short-time mixing as described above.

4. With the average diameter of WC grain being the same among the cemented carbides, the thermal diffusivity tends to be low when the content of the added element(s) is too large.

5. A cemented carbide having a coercive force Hc equal to or smaller than 16 kA/m tends to have a high thermal diffusivity.

6. In the case where the pre-process is performed in a manner of the wet processing, a cemented carbide having a high thermal diffusivity tends to be obtained.

Figure 2:
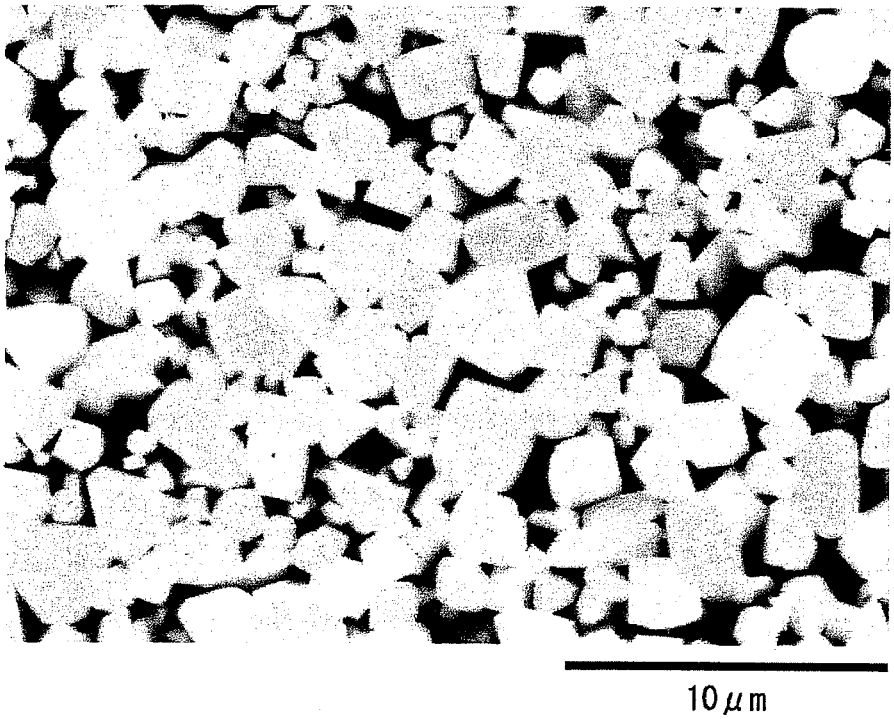
FIG. 2 shows scanning electron microscope images of cemented carbides (magnification of 4000), FIG. 2(I) showing a sample No. 12, FIG. 2 (II) showing a sample No. 103.
Figure 2:
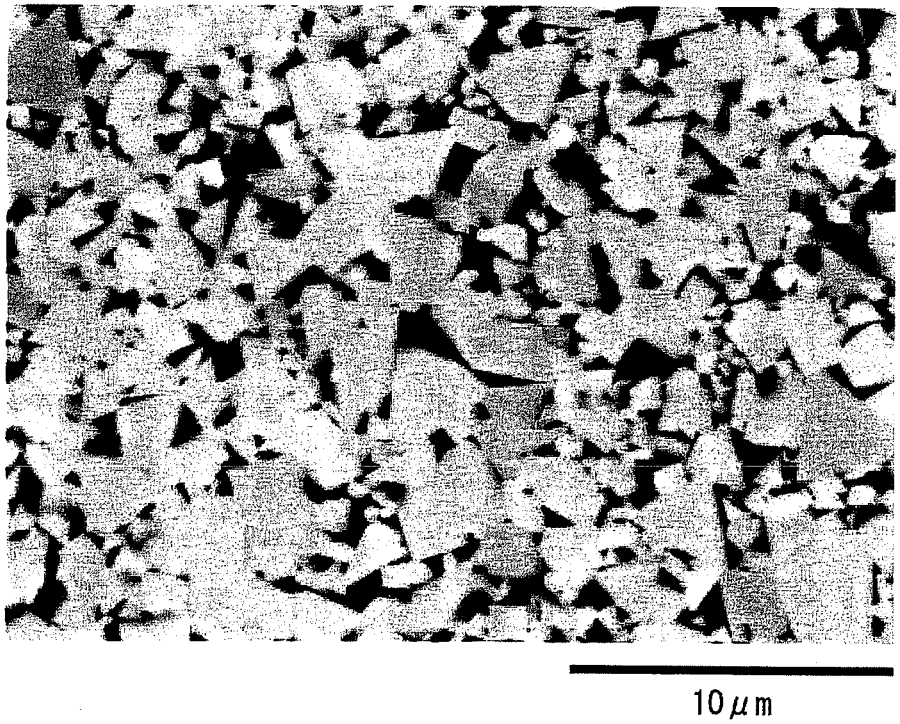

FIG. 2(I) shows an SEM image (magnification of 4000) of a cross section of sample No. 12. FIG. 2(II) shows an SEM observation image (magnification of 4000) of a cross section of sample No. 103. In FIG. 2, gray-colored particles represent the hard phase grains. As shown in FIG. 2(I), it can be seen that the hard phase grains of sample No. 12 obtained by performing the specific pre-process before the short-time mixing were rounded and sample No. 12 provided a structure having fewer fine grains. In contrast, each of the hard phase grains of sample No. 103 having been through the long-time mixing had a shape having a sharp edge, and sample No. 103 provided a structure having a multiplicity of fine grains.

For each of samples No. 6, 8, 12, 102, 103, and 104, the above-described average number of sharp edges was calculated. Results thereof are shown in Table 3.

TABLE 3

| Sample No. | Average Number of Sharp Edges |
|---|---|
| 6 | 0.25 |
| 8 | 0.23 |
| 12 | 0.22 |
| 102 | 0.35 |
| 103 | 0.34 |
| 104 | 0.37 |

As shown in Table 3, it is understood that the average number of sharp edges in each of samples No. 6, 8, and 12 satisfying X>0.055x+0.238 was small, specifically, was equal to or smaller than 0.25 and WC in the cemented carbide therefore had a rounded shape.

Test Example 2

Cutting tools were fabricated using the cemented carbides fabricated in test example 1, as their base materials. A cutting property of each of the cutting tools was examined.

Each of the cutting tools (base materials) used in this test was fabricated by drying the mixed powders in a manner similar to that in test example 1, fabricating a press molding body having a shape of SNGN120804, and sintering this molding body under conditions similar to those in test example 1. The obtained cutting tool was evaluated in terms of wear resistance, thermal crack resistance, and toughness by means of cutting tests conducted under conditions described below. Results of the abrasion resistant test, the thermal crack resistance test, and the toughness test are shown in Table 4.

[Wear Resistance]

Test objects: samples No. 6, 8-12, 14, 17-20, 23, 27, 105, and 106

Workpiece (mass %): Ti-6A1-4V material (round bar)

Cutting speed: V=70 m/min; Feed rate: f=0.1 mm/rev.; Depth of cut: d=1 mm; Cutting process by turning in wet (wet processing)

Evaluation: flank face wear amount Vb (mm) after cutting for 9 minutes.

[Thermal Crack Resistance]

Test objects: samples No. 6, 9, 11, 12, 17-20, 23, 25, 102, and 103

The cutting tools used were coated cutting tools, each of which was coated, by means of the CVD method, with a TiCN film (thickness: 4 μm) and an $Al_2O_3$ film (thickness: 1 μm) in this order on its cutting tool tip (base material) constituted of the cemented carbide.

Workpiece: SCM435

Cutting speed: V=250 m/min; Feed rate: f=0.3 mm/cutting edge; Depths of cut: Ad=2 mm, Rd=40 mm; milling in wet (wet processing)

Evaluation: the number of cracks produced at the flank face due to thermal crack damage, and the average length (mm) of the cracks were measured with the cutting being stopped when the cutting distance reached 1200 mm.

[Toughness]

Test objects: samples No. 6, 9, 11, 12, 17, and 26

The cutting tools used were coated cutting tools, each of which was coated, by means of the PVD method, with a TiAlN film (thickness: 3 μm) on its cutting tool tip (base material) constituted of the cemented carbide.

Workpiece: SCM435 (round bar with four grooves)

Cutting speed: V=100 m/min; Feed rate: f=0.2 mm/rev.; Depth of cut: 2 mm;

Intermittent Cutting Process (Turning) in Dry (Dry Processing)

Evaluation: a cutting time until its cutting edge was chipped was measured for 10 corners in total and an average time (minute) of the 10 corners was evaluated. Maximum cutting time was 10 minutes.

TABLE 4

| Wear Resistance Workpiece Ti—6Al—4V | | Thermal Crack Resistance Workpiece SCM435 | | | Toughness Workpiece SCM435 (with grooves) | |
|---|---|---|---|---|---|---|
| Sample No. | Flank Face Wear Amount Vb (mm) | Sample No. | Number of Cracks | Average Crack Length (mm) | Sample No. | Average Time (minute) |
| 6 | 0.122 | 6 | 3 | 0.29 | 6 | 7.4 |
| 8 | 0.146 | 9 | 2 | 0.14 | 9 | 6.2 |
| 9 | 0.123 | 11 | 2 | 0.15 | 11 | 9.1 |
| 10 | 0.140 | 12 | 2 | 0.14 | 12 | 9.8 |
| 11 | 0.145 | 17 | 2 | 0.22 | 17 | 4.2 |
| 12 | 0.125 | 18 | 2 | 0.13 | 26 | 1.2 |
| 14 | 0.135 | 19 | 2 | 0.17 | | |
| 17 | 0.108 | 20 | 2 | 0.11 | | |
| 18 | 0.162 | 23 | 2 | 0.08 | | |
| 19 | 0.170 | 25 | 2 | 0.05 | | |
| 20 | 0.189 | 102 | 4 | 0.57 | | |
| 23 | 0.235 | 103 | 3 | 0.49 | | |
| 27 | 0.305 | | | | | |
| 105 | 0.397 | | | | | |
| 106 | 0.560 | | | | | |

Each of the cemented carbides satisfying X>0.055x+0.238 had a higher thermal diffusivity than a cemented carbide having the same average diameter of WC grain as described above. Hence, each cutting tool utilizing as the base material the cemented carbide satisfying X>0.055x+0.238 had more excellent thermal crack resistance than those of samples No. 102 and 103 having a similar average diameter of WC grain but not satisfying X>0.055x+0.238. Further, the cutting tool including the base material formed of the cemented carbide satisfying X>0.055x+0.238 had more excellent wear resistance than those of samples No. 105 and 106. In particular, the cutting tool utilizing the cemented carbide having the high thermal diffusivity as its base material was excellent in wear resistance even in a cutting process involving great heat generation during the cutting, specifically, a cutting process of cutting a difficult-to-cut material such as a Ti alloy as in the above-described test. Further, it is understood from Table 4 that for such a tool for processing titanium, it is preferable to use a cemented carbide that contains Co at a content of not less than 4.5 mass % and not more than 9 mass % and contains Cr at a content of not less than 0.05 mass % and not more than 1.2 mass %, wherein the average diameter of the hard phase grains is not less than 0.5 μm and not more than 3 μm.

Meanwhile, it is also understood that the cemented carbide of sample No. 27, which satisfied X>0.055x+0.238 but had a too large total content of Co and Ni, was inferior in wear resistance. On the other hand, it is also understood that sample No. 26 with too small total content of Co and Ni was inferior in toughness.

Accordingly, it can be said that a cemented carbide suitable as a material for such a cutting tool is one satisfying X>0.055x+0.238 and containing Co and Ni at a total content of not less than 4 mass % and not more than 15 mass %, particularly, not less than 6 mass % and not more than 13 mass %. In addition, it can be said that a cemented carbide more excellent in thermal crack resistance, wear resistance, and toughness and more suitable as a material for such a cutting tool has WC grains having an average diameter of not less than 0.4 μm and not more than 4.0 μm, in particular, not less than 0.8 μm and not more than 2.4 μm.

Test Example 3

Coated cutting tools were fabricated in each of which a coated film was formed on a base material formed of a cemented carbide. A cutting property of each of the coated cutting tools was examined.

Each sample was fabricated in the following manner. As source material powders, WC powders, $Cr_3C_2$ powders, TaC powders, and Co powders (powders β) similar to those used in test example 1 were prepared. In particular, the WC powders were those carbonized at a high temperature and having an average particle diameter selected appropriately. The source material powders thus prepared were added together to obtain a predetermined composition. The source material powders thus added together were subjected to the pre-process under the same conditions as those in test example 1 using a wet type jet mill, and then were mixed by a ball mill for 1.5 h. Thereafter, the source material powders were subjected to the following steps: drying→molding (at a molding pressure of 1000 kg/cm$^2$)→sintering (in a vacuum atmosphere at 1400°

C. for 1 hour). In this way, a cutting tool tip (base material) formed of the cemented carbide with a shape of SNGN120804 was obtained. This base material was then coated with a TiCN film (thickness: 4 μm) and an $Al_2O_3$ film (thickness: 1 μm) in this order using the CVD method, thereby obtaining the coated cutting tool of each of samples No. 31-41. Each of the coated cutting tools thus obtained was subjected to a high-speed intermittent cutting test under below-described conditions to evaluate its thermal crack resistance. Results thereof are shown in Table 5. The evaluation for the thermal crack resistance was made in a manner similar to that in test example 2.

Workpiece: S50C

Cutting speed: V=300 m/min; Feed rate: f=0.3 mm/cutting edge; Depths of cut: Ad=2 mm, Rd=30 mm; milling in wet (wet processing).

Further, the average diameter (μm) of the WC grains in each cemented carbide, the contents (mass %) of Cr, Ta, and Co therein, and the thermal diffusivity ($cm^2$/sec) thereof were measured in a manner similar to that in test example 1. Results thereof are shown in Table 5. Further, assuming that the average diameter of the WC grains in each cemented carbide is represented by x and the thermal diffusivity thereof is represented by X, a value of X=0.055x+0.238 was determined. Results thereof are also shown in Table 5. It should be noted that the composition of the hard phase of each of the cemented carbides was examined in a manner similar to that in test example 1, and it was found that the hard phase of each of the samples was substantially constituted of the WC grains. Further, each of the cemented carbides contained the WC at not less than 80 mass %.

TABLE 5

| Sample No. | Average Diameter of WC Grain in Cemented Carbide (μm) | Component (mass %) Cr | Ta | Co | Thermal Diffusivity ($cm^2$/sec) | X = 0.055x + 0.238 | Evaluation Number of Cracks | Average Crack Length (mm) |
|---|---|---|---|---|---|---|---|---|
| 31 | 1.8 | 0 | 0.5 | 10 | 0.376 | 0.337 | 7 | 0.45 |
| 32 | 1.8 | 0.1 | 1 | 10 | 0.378 | 0.337 | 5 | 0.28 |
| 33 | 1.8 | 1.5 | 0.5 | 10 | 0.372 | 0.337 | 4 | 0.25 |
| 34 | 1.8 | 2.5 | 1 | 10 | 0.368 | 0.337 | 8 | 0.48 |
| 35 | 1.8 | 0.1 | 8 | 10 | 0.342 | 0.337 | 14 | 0.40 |
| 36 | 1.8 | 1.5 | 0 | 10 | 0.378 | 0.337 | 10 | 0.44 |
| 37 | 3.0 | 1.5 | 3 | 10 | 0.406 | 0.403 | 6 | 0.34 |
| 38 | 0.8 | 1.5 | 0 | 10 | 0.302 | 0.282 | 14 | 0.44 |
| 39 | 1.8 | 0.6 | 0.6 | 6 | 0.387 | 0.337 | 8 | 0.48 |
| 40 | 1.8 | 0.6 | 0 | 8 | 0.382 | 0.337 | 10 | 0.45 |
| 41 | 1.8 | 1.5 | 2 | 14 | 0.363 | 0.337 | 10 | 0.44 |

As shown in Table 5, it is understood that a coated cutting tool including a base material formed of the following cemented carbide was excellent in thermal crack resistance property. The cemented carbide satisfied X>0.055x+0.238, contained Co at a content of 7-12 mass %, contained Cr at a content of 0.05-2 mass %, and contained Ta at a content of 0.2-5 mass %, wherein an average diameter of WC grains was not less than 1 μm and not more than 4 μm. Hence, the cutting tool including such a cemented carbide is expected to be suitably used as a tool required to have a excellent thermal crack resistance, in particular, a tool for machining a crankshaft.

It should be noted that the above-described embodiment can be modified appropriately without deviating from the gist of the present invention and is not limited to the configuration described above. For example, the composition of the cemented carbide or the average grain diameter of the source material powders can be appropriately modified.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

INDUSTRIAL APPLICABILITY

The cemented carbide of the present invention is suitably used as a cutting tool such as an indexable insert. The cemented carbide of the present invention is suitably used as a material for a cutting tool, which is used under a condition that its cutting edge is to have a very high temperature, in particular, in the case of high-speed cutting or machining of a difficult-to-cut material. The cutting tool of the present invention is suitably used for milling, a process of cutting a difficult-to-cut material, and a heavy cutting process.

The invention claimed is:

1. A cemented carbide in which a hard phase containing WC the most is bound by a binder phase containing Co the most, said binder phase being substantially constituted of Co, or Co and Ni, a total content of Co and Ni being not less than 4.5 mass % and not more than 15 mass % with respect to the total mass of the cemented carbide, the WC grains in the cemented carbide having an average diameter of not less than 0.4 μm, and not more than 4 μm, when the average diameter of the WC grains in the cemented carbide is represented by x (μm), the cemented carbide having a thermal diffusivity X ($cm^2$/sec) satisfying X>0.055x+0.238, and in a cross section of the cemented carbide, the average number of sharp edges per WC grain being not more than 0.25, said average number of sharp edges per WC grain being determined by dividing the number of sharp edges each having a curvature radius of 100 nm or smaller among the edges of the WC grains by the average number of WC grains.

2. The cemented carbide according to claim 1, wherein the cemented carbide further contains only Cr at not less than 0.05 mass % and not more than 3 mass %.

3. The cemented carbide according to claim 1, wherein the cemented carbide further contains Cr and one or more elements selected from Ta, Nb, Zr, and Ti, and the total content of said Cr and one or more elements being not less than 0.05 mass % and not more than 5 mass % with respect to the total mass of the cemented carbide.

4. The cemented carbide according to claim 3, wherein the cemented carbide contains Cr and one or more elements of Ta and Nb, and the total content of said Cr and one or more elements being not less than 0.05 mass % and not more than 5 mass % with respect to the total mass of the cemented carbide.

5. The cemented carbide according to claim 1, wherein said binder phase is substantially constituted of Co and Ni, and a content of Ni therein is not more than 25% relative to the total content of Co and Ni.

6. The cemented carbide according to claim 1, wherein the cemented carbide has a coercive force (Hc) equal to or smaller than 16 kA/m.

7. The cemented carbide according to claim 1, wherein:

the cemented carbide further contains Cr at not less than 0.05 mass % and not more than 2 mass %, and contains Ta at not less than 0.2 mass % and not more than 5 mass %, grains constituting said hard phase has an average grain diameter of not less than 1 μm and not more than 4 μm, a content of Co therein is not less than 7 mass % and not more than 12 mass %, and the cemented carbide is used for a tool for machining a crankshaft.

8. The cemented carbide according to claim 1, wherein:

the cemented carbide further contains Cr at not less than 0.05 mass % and not more than 1.2 mass %, grains constituting said hard phase has an average grain diameter of not less than 0.5 μm and not more than 3 μm, a content of Co therein is not less than 4.5 mass % and not more than 9 mass %, and the cemented carbide is used for a tool for machining titanium.

9. A cutting tool comprising:

a base material formed of the cemented carbide recited in claim 1; and a coated film formed on a surface of said base material by means of a PVD method, said coated film including one or more of diamondlike carbon (DLC) and a compound of a first element and a second element, the first element being one or more of elements of groups 4a, 5a, and 6a in a periodic table, Al, and Si, the second element being one or more of carbon (C), nitrogen (N), oxygen (O), and boron (B).

10. A cutting tool comprising:

a base material formed of the cemented carbide recited in claim 1; and a coated film formed on a surface of said base material by means of a CVD method, said coated film including one or more of diamond and a compound of a first element and a second element, the first element being one or more of elements of groups 4a, 5a, and 6a in a periodic table, Al, and Si, the second element being one or more of carbon (C), nitrogen (N), oxygen (O), and boron (B).

* * * * *